US005438922A

United States Patent [19]

Bubley et al.

[11] Patent Number: 5,438,922

[45] Date of Patent: Aug. 8, 1995

[54] AUTOMATED TEXTILE PRINTING APPARATUS

[75] Inventors: Henry J. Bubley, Deerfield, Ill.; David Landesman, St. Louis, Mo.

[73] Assignee: Lawson Screen Products, Inc., St. Louis, Mo.

[21] Appl. No.: 142,876

[22] Filed: Oct. 25, 1993

[51] Int. Cl.[6] ..... B41L 27/00

[52] U.S. Cl. ..... 101/123; 101/115

[58] Field of Search ..... 101/123, 115, 114, 129, 101/127.1, 35, 41, 126

[56] References Cited

U.S. PATENT DOCUMENTS

| | | | |
|---|---|---|---|
| 2,991,711 | 7/1961 | Ehrhard et al. | 101/126 |
| 3,427,964 | 2/1969 | Vasilantone | 101/115 |
| 3,731,623 | 5/1973 | Bubley et al. | 101/114 |
| 3,828,671 | 8/1974 | Fuchs | 101/123 |
| 3,955,501 | 5/1976 | Bubley et al. | 101/123 |
| 4,099,460 | 7/1978 | Bubley et al. | 101/123 |
| 4,254,708 | 3/1981 | Bubley et al. | 101/123 |
| 4,276,826 | 7/1981 | Bubley et al. | 101/123 |
| 4,342,260 | 8/1982 | Sala et al. | 101/126 |
| 4,583,458 | 4/1986 | Beachum | 101/126 |
| 4,589,336 | 5/1986 | Klemm | 101/123 |
| 4,648,317 | 3/1987 | Bubley et al. | 101/123 |
| 4,669,378 | 6/1987 | Lee | 101/115 |
| 4,724,760 | 2/1988 | Bubley | 101/115 |
| 4,753,162 | 6/1988 | Bubley | 101/115 |
| 4,841,854 | 6/1989 | Bubley | 101/123 |
| 4,949,635 | 8/1990 | Padula | 101/115 |
| 4,974,508 | 12/1990 | Andersen et al. | 101/115 |
| 5,161,460 | 11/1992 | Andersen et al. | 101/127.1 |

FOREIGN PATENT DOCUMENTS

| | | | |
|---|---|---|---|
| 2068836 | 8/1981 | United Kingdom | 101/126 |

OTHER PUBLICATIONS

Satellite "The" automatic Round Screen Printing Machine Jan. 1990.

*Primary Examiner*—Edgar S. Burr
*Assistant Examiner*—Anthony H. Nguyen
*Attorney, Agent, or Firm*—Kalish & Gilster

[57] ABSTRACT

A screen printing apparatus has simultaneously movable multiple print heads made movable by a single fluid cylinder. The apparatus also has multiple printing platens, and structure for indexing and simultaneously registering the multiple platens into printing position, as well as combined flood bar/squeegee ink applicators which are capable of simultaneously shifting of operational positions, and provide a high quality printed image on the goods printed thereby.

19 Claims, 4 Drawing Sheets

AUTOMATED TEXTILE PRINTING APPARATUS

BACKGROUND AND SUMMARY OF THE INVENTION

The present invention relates generally to the field of textile printing apparatuses and, more particularly, to a multi-head, carousel-type textile printing apparatus in the mid-price range. The new printing apparatus has several unique structures for effecting head movement, printing, and rotational indexing and registration of the carousel and platens mounted thereon.

Previously, carousel-type textile printing machines for applying words and designs to fabric, such as T-shirts, jackets and the like generally fell into two categories: those which are highly automated, high-speed, and thus, very expensive, for example in the range of $30,000 to $80,000 for one machine; and those which are entirely manually operated. The latter of course operate much more slowly, allowing printing of perhaps two or three dozen pieces per hour, but are much less expensive to manufacture, and thus the cost is, for example, approximately $6,000 or $7,000.

Accordingly, a need exists in the marketplace for a multiple head textile printing apparatus in the mid-price range (approximately $12,000 to $17,000) for use in print shops of intermediate size which may wish to print quantities up to approximately 40 to 60 dozen pieces per hour with use of only a single machine without additional labor costs to produce the pieces.

To meet this need it is necessary that the multiple heads of the new carousel-type printing apparatus be automatically coordinated in their vertical action, as well as in their registration over the respective work pieces, so that multiple operators are not required to be positioned at all times at each of up to, for example, six or seven printing heads. Satisfying this need would avoid additional labor costs in producing each printed piece.

In order to keep the cost of manufacturing the apparatus and operating same to a minimum, it is also necessary that the flooding of the print screen with ink and printing therewith be as automated and efficient as possible, while still providing high quality, unsmudged prints, but in a mechanically simple manner.

A large portion of the expense involved in manufacturing fully automated multi-head carousel-type printers is involved in the structure for automatic rotational indexing and registration of the carousel carrying the printing platens. When the carousel stops it is especially important that each platen thereon be positioned in precise registration under a printing head so that the printed design will be properly aligned on the work piece.

Known printing machines have previously required time-consuming, and thus expensive manual adjustment for proper registration, resulting in a lower manufacturing cost; or alternatively, the machines were formed with complex and thus expensive equipment for automatic indexing and registration. The new textile printing apparatus described below is provided with a carousel which has both a relatively simple, inexpensive structure, and yet is capable of providing fast, precise registration between the printing head and the work piece platen.

For moving each of the multiple heads of a printing machine, known machines commonly employ a pneumtic lift cylinder for each head. These lift cylinders can be positioned in close proximity to the inner end of the printing head. Alternatively, the cylinders can be positioned at an opposite, outer end of the print head. The multiplicity of lift cylinders provides an additional source of substantial manufacturing expense. Further, the multiplicity of lift cylinders offers an increased chance of malfunction requiring maintenance cost. Finally, the multiplicity of lift cylinders makes precise coordination of simultaneously lifting and lowering all print heads more difficult. The new textile printing apparatus described below has a relatively simple structure which also allows for improved simultaneous lifting and lowering of all print heads. The simplified structure of the new textile printing apparatus also reduces the chances of malfunction of an individual print head in raising and lowering.

Different approaches to the actual step of printing have been used in the past. Highly automated machines often include a flood bar for spreading the ink and a "squeegee" for scraping excess ink from the print screen which are separately mounted on individual, parallel support bars. In such an arrangement separate power and actuator arrangements are necessary to operate the flood bar and the squeegee up and down in a chopping fashion, and to cause them to move back and forth on the print screen. The required duplication of structure for separate operation of the two devices is complex to manufacture and thus entails a great deal of expense.

At the opposite end of the cost spectrum is the older method of flooding and scraping or shaving the ink on the screen. One way of doing this is by an arrangement in which two squeegees are mounted on the same rigid arm which is formed so as to have a side view appearance of an inverted "Y". This structure is sometimes referred to as a "flip-flop" squeegee because it is movable in a back and forth manner so that one blade is used to spread or "flood" the ink across the print screen and then, after flipping to the second position, the second blade is used to scrape the excess ink away, forcing some of the ink down into open spaces in the screen in the usual screen printing manner.

The drawback with known flip-flop double squeegee applicators is that, although less expensive because of combined operating structure, they tend to produce an inferior product by smearing the print design. This is a result, at least in part, of two squeegees being used and the inability to obtain precise control thereof.

Thus, in the present invention it was desired to use a combined squeegee and flood bar (or "coating blade") mounted on the same "Y" structure for use in a flip-flop fashion. However, a great deal of difficulty is encountered in making such a device which will function adequately. The problem is that replacing one squeegee with a flood bar results in inadequate scraping of excess ink, and thus poor print quality. The applicants have discovered that the key constraint in achieving satisfactory shaving of the ink is the squeegee blade angle. Further, there is a particular blade angle which is critical for appropriate scraping or ("shaving") of the excess ink from the screen, while still having inexpensive, combined mounting and operation features.

Thus, it is among the several objects of the present invention to provide a mid-priced, multi-head, carousel-style textile printing apparatus which provides high quality prints, which is highly automated for improved speed of operation over fully manual models, and which is operable by only one or two individuals for improved efficiency of the overall printing operation, as well as reduction of operator fatique, yet is constructed so as to be capable of manufacture at a significantly lower cost than known, fully automated, high-speed, multi-head carousel textile printing apparatuses.

It is also among the objects of the present invention, having the features indicated that the new printing apparatus have precisely coordinated simultaneous lifting and lowering of all print heads thereon, while also providing for manual control of carousel movement for economy of manufacture, as well as for versatility and completeness of use, and further providing that the carousel stopping, head registration, and lifting of each print head from its printing position over a corresponding platen all be precisely and simultaneously controlled by a single operator with readily accessible controls which are positioned and designed for facile access and operation.

It is further among the objects of the present invention to provide an automated textile printing apparatus having the above-mentioned features which is of relatively simple mechanical construction for economy of manufacture and ease of operation, while at the same time requiring a minimal amount of maintenance which, when necessary, is simply accomplished.

Accordingly, in furtherance of the above objects, the invention is, briefly, a screen printing apparatus having simultaneously movable multiple print heads made movable by a single fluid cylinder. The apparatus has multiple printing platens and structure for indexing and simultaneously registering the multiple platens into printing position, and combined flood bar/squeegee ink applicators which are capable of simultaneously shifting of operational positions, and provide a high quality printed image on the goods printed thereby.

The invention is also, briefly, for use in combination with a multi-head type textile printing apparatus, a mechanism for effecting simultaneous lifting and lowering of all print heads. The printing apparatus has a plurality of print heads extending outwardly from the apparatus, each one of the plurality of print heads having an inner end projecting toward a vertical axis of the apparatus and each one of the plurality of print heads being pivotally mounted on the apparatus at a point on the print heads outward from the inner end of the corresponding print head, to thereby permit upward and downward pivotal motion of the print head. The mechanism for effecting simultaneous lifting and lowering includes structure for contacting the inner end of each one of the plurality of print heads. The structure for contacting is vertically movably mounted on the apparatus above the inner end of each one of the plurality of print heads and in sliding contact with the inner ends. The mechanism also includes structure for vertically movably mounting the structure for contacting connected thereto in such manner as to be vertically movable along the vertical axis of the apparatus. The mechanism also includes structure for effecting vertical movement of the means for vertically movably mounting the structure for contacting, to thereby cause lifting of each one of the plurality of print heads upon downward vertical movement of the structure for effecting vertical movement and lowering of each one of the plurality of print heads upon upward vertical movement of the structure for effecting vertical movement.

The invention is also, briefly, for use in combination with a carousel-type multi-head textile printing apparatus, a mechanism for effecting simultaneous indexing and registration of all printing platens on the apparatus. The printing apparatus has a plurality of print heads extending radially outwardly from the apparatus for simultaneous printing of a plurality of work pieces and a plurality of printing platens, a plurality of spaced apart rigid spokes extending radially outwardly from the printing apparatus in such manner that all of the rigid spokes are simultaneously rotatable around the apparatus in a horizontal plane, each one of the plurality of rigid spokes having one of the plurality of printing platens mounted thereon, the plurality of rigid spokes being spaced at intervals around the apparatus so as to be capable of alignment of substantially each one of the platens beneath a corresponding one of the plurality of print heads. And, the mechanism for effecting simultaneous indexing and registration of printing platens on the apparatus includes a contact rollably mounted to and extending beneath each one of the plurality of rigid spokes of the apparatus, a vertically movable stop fixed on the apparatus and positioned so as to contact a next one of the contacts upon rotational movement of the plurality of rigid spokes. The stop is adapted for receiving a contact which comes into contact therewith, to thereby rotationally lock the plurality of rigid spokes to precisely register the plurality of print heads above corresponding printing platens. The stop is further adapted for release of a contact which has been received thereby to permit an operator of the apparatus to move the plurality of rigid spokes rotationally around the apparatus so that the contact on another one of the plurality of rigid spokes can come into contact with the stop, locking the associated one of the rigid spokes, to thereby index the apparatus to another printing position and register the platen for the other printing position precisely beneath a selected one of the plurality of printing heads for printing of a work piece on the platen.

The invention is also, briefly, for use in combination with a textile printing apparatus, a mechanism for coordinated operation of a flood bar and a squeegee. The printing apparatus has at least one print head for extending over a work piece of printing thereof, and at least one platen for supporting a work piece beneath the print head during the printing operation. And, the mechanism for coordinated operation of a flood bar and a squeegee includes an elongated flood bar, an elongated squeegee, a carriage movably mounted to the at least one print head for travel therebeneath of the carriage above the work piece for printing thereof, and structure for causing the carriage to move. Also included in the mechanism is a mounting strip adapted for mounting the flood bar and the squeegee thereon, the mounting strip having an angle formed therein so that the strip is bent along the entire length thereof, the flood bar being connected to the mounting strip on one side of the bend and the squeegee being connected to the mounting strip on the other side of the bend. The strip is pivotally connected to the carriage. And the mechanism also includes structure for causing the mounting strip to pivot connected to the mounting strip, to thereby affect which of the flood bar and the squeegee is in operating position for performing the particular function thereof with regard to printing of the work piece.

Other objects will be in part apparent and in part pointed out hereinbelow.

BRIEF DESCRIPTION OF THE DRAWINGS

Throughout the drawings like parts will be indicated by like element numbers.

DESCRIPTION OF THE PREFERRED EMBODIMENT

Figure 1:
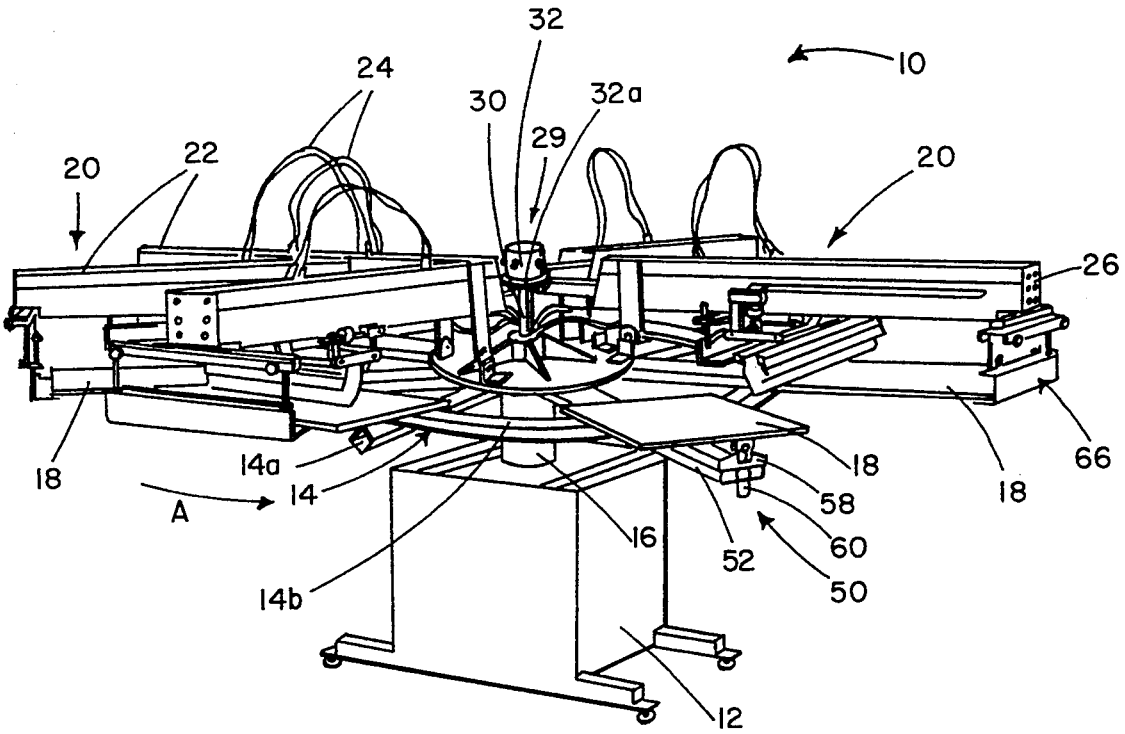
FIG. 1 is a perspective view of an automated textile printing apparatus constructed in accordance with and embodying the present invention.

With reference to the drawings, 10 generally indicates a textile printing apparatus in accordance with the invention. Printing apparatus 10 is of the multi-head carousel type having a central, floor supported base 12 for housing electronic controls in the usual manner and horizontally rotatably supporting thereon a steel carousel 14.

Carousel 14 consists of at least one ring 14*a* and a plurality of rigid spokes 14*b* which are fixed to the ring and extend horizontally inwardly to connect centrally with a support column 16 which is rotatably mounted centrally on base 12 and acts as a vertical support shaft. Carousel 14 serves as a rotatable, "lazy-susan" type of support for a number of printing platens 18 which are adjustably connected spacedly around the circumference of the carousel at the ends of the individual spokes.

As an example, eight platens 18, preferably formed of aluminum and made in a selection of sizes, can be provided. Six may be used for actual printing and thus will each have a print head carrying a single color of ink, generally designated 20 positioned thereover, as shown in FIG. 1, when carousel 14 is positioned for printing. The empty head stations are used by one or two operators to apply and remove the textile goods to and from the appropriate platen 18 in the usual manner. Optionally, fewer or more platens may be used for actual printing.

Each print head 20 has a heavy elongated arm 22 with electrical wiring 24 attached in the usual manner for supplying power for operation of a microcontrol panel 26 which is mounted at the outer end of each arm 22. Each arm 22 extends outwardly over a corresponding platen 18 when device 10 is in printing position, as shown in FIG. 1.

Figure 6:
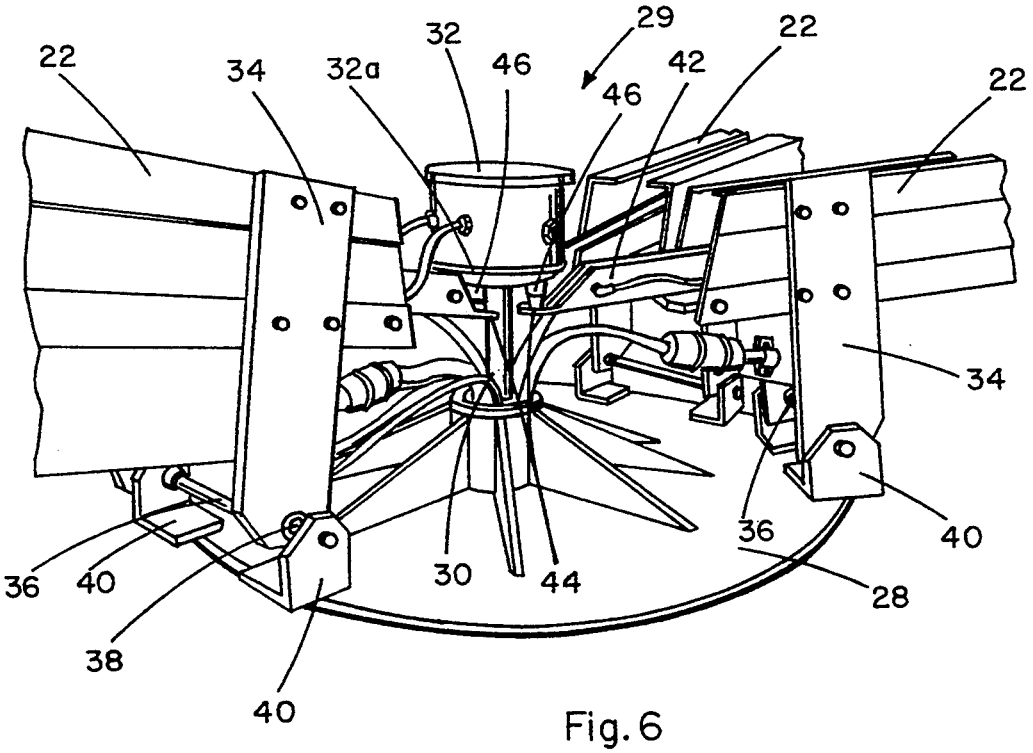
FIG. 6 is an enlarged view, partially broken away, of the head lifting mechanism of the apparatus of FIG. 1.

As shown in FIG. 6, and generally designated 29 is a new and elegantly simple head lift mechanism which causes all printing heads 20 of device 10 to move simultaneously up and down in a smooth, predictable and controlled manner.

At an inwardly directed end thereof each arm 22 is pivotally connected to a rigid, preferably round mounting plate 28. Mounting plate 28 is rotatably disposed on column 16 above base 12 and is centrally penetrated by a piston 30 connected to a preferably pneumatic cylinder (not shown) housed within base 12. To the upwardly directed end of piston 30 is connected a longitudinally disposed spool-shaped head 32 having an outwardly directed annular flange 32*a* at the bottom end thereof.

For strong, secure pivotal connection to plate 28 each arm portion 22 of each printing head 20 has connected, for example by bolting, at its inwardly directed end on each side thereof a rigid, elongated depending side bracket 34 which extends downwardly and is rotatably penetrated by a pivot shaft 36. Each pivot shaft 36 extends at its opposed ends outwardly through and beyond a corresponding side bracket 34 which is separated by a bushing 38 rotatably penetrated by shaft 36 from an L-bracket 40. Each L-bracket 40 is non-movably fixed to mounting plate and is securely connected to an end of pivot shaft 36.

Mounted as described, side brackets 34 of each arm 22 rotate slightly forward and back on pivot shaft 36 as an attached printing head moves up and down. To accomplish the required up and down movement of each printing head an extension bar 42 is rigidly connected to the centrally extending end of each arm 22. The most inward end of each extension bar 42, is directed toward piston 30 and has a stiff flange 44 having a preferably smooth, round-surfaced bumper 46 disposed on the upper surface thereof. Each extension 42 and bumper 46 attached thereto is positioned so that the bumper contacts the lower surface on flange 32*a* of head 32.

Thus, when piston 30 is activated upwardly all print heads simultaneously pivot downwardly (under the force of their own weight) at their outer ends, in a "teeter-totter" manner, as bumpers 46 follow flange 32*a* upwardly. Conversely, when it is desired to raise the print heads, retraction of piston 30 places force on each bumper 46 and leverages the attached printing heads simultaneously, upwardly as their tilt on their respective pivot shafts 36. It is noted that while the print heads pivot vertically, the print heads do not achieve the lateral rotational movement experienced by the carousel and the platens. It is preferred that bumpers 46 be formed of hardened steel ball bearings for durability and smoothness of action. However, other materials and forms will adequately suffice.

Figure 7:
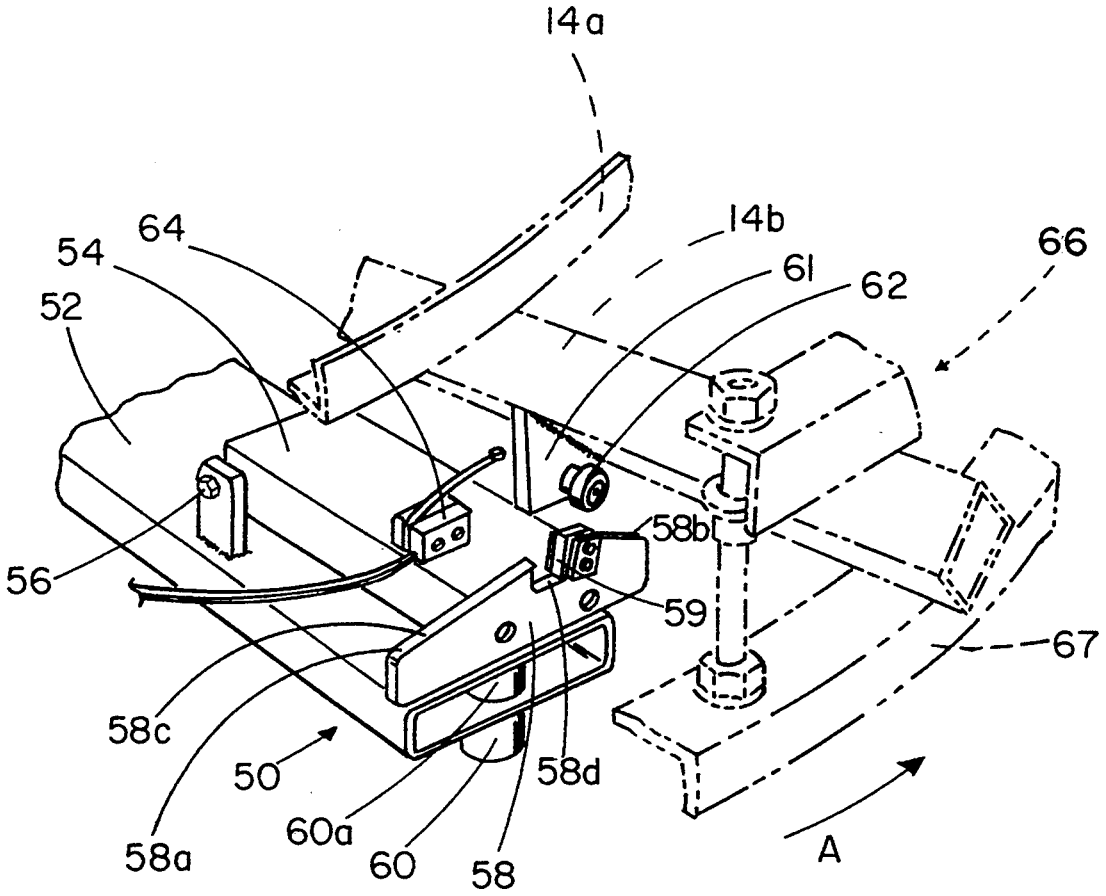
FIG. 7 is an enlarged view, partially broken away of the indexing and registration mechanism of the apparatus of FIG. 1.

FIG. 7 illustrates a new carousel stop mechanism, generally designated 50, constructed in accordance with and embodying the present invention, for effecting simultaneous indexing and registration of all platens. Stop mechanism 50 is located generally beneath any one printing platen position, from which position the corresponding printing head 20 has been removed. It is ordinarily at this position that an operator of apparatus 10 will stand to place the work piece on the free platen and to control the overall operation of the textile printing apparatus.

Generally speaking, stop mechanism 50 consists of a pneumatically-powered vertically-movable ramp which selectively slows and stops the rotational movement of carousel 14 by engaging one of spokes 14*b*. By engaging one of spokes 14*b*, stop mechanism 50 precisely registers each platen beneath the corresponding printing head, and substantially simultaneously activating lowering of printing heads 20 to printing position.

More specifically, an elongated section of channel iron forms a mounting bar 52 for stop mechanism 50. Mounting bar 50 is secured at its inwardly directed end, beneath carousel 14, to the top of base 12 and extends horizontally to an outwardly directed end, preferably terminating somewhat outwardly of carousel ring 14*a*.

A locking arm 54 is formed by a shorter piece of channel iron and is mounted longitudinally on the upper surface of mounting bar 52, adjacent to the outer end thereof, by bracket and bolt assemblies 56 which pivotally connect the inwardly directed end of locking arm 54 to the bar. The outwardly directed end of locking arm 54 is substantially adjacent to the outer end of mounting bar 52, which latter is centrally, vertically penetrated by an air cylinder 60 mounted thereon. Air cylinder 60 is normally activated so that locking arm 54 is usually in the upward position.

Upon activation by the press 10 operator, for example via a foot pedal (not shown), the piston 60*a* of air cylinder 60 retracts, downwardly, through aligned apertures formed vertically through both upper and lower walls of the outer end of mounting bar 52 and permits locking arm 54, the lower surface of the outer end of which rests upon piston 60*a* to drop, thereby causing locking arm 54 to pivot downwardly toward horizontal mounting bar 52.

At the extreme outer end of locking bar 54 there is attached a vertically disposed ramp 58 having an approach end 58*a* on the left side thereof and a take-off end 58*b* on the right side thereof. Approach end 58*a* of ramp 58 has an upper edge 58*c* which slopes gently upwardly, to the operator's right (to the right of the drawing) and continues, although interrupted, across the top of ramp 58. At the top of the slope of edge 58*c* a deep notch 58*d* is formed for acting as a detent and is provided on a right hand wall thereof with a rubber bumper 59 fixed thereto. Beyond the position of notch 58*d* upper wall 58*c* slopes downwardly to the right.

Each carousel spoke 14*b* has positioned slightly inwardly on the lower surface of its outer end a depending flange 61 with a vertically disposed roller bearing 62 rotatably mounted thereon. Roller bearing 62 is in vertical alignment with locking ramp 58 when the particular platen 18 and spoke connected thereto is above a ramp 58 and registration mechanism 50.

In operation, when the carousel 14 is manually moved to the operator's right (counterclockwise, in the direction indicated by arrow A in FIG. 1), corresponding roller bearing 62 contacts approach end 58*a* of locking ramp 58 and travels up edge 58*c* so that the oncoming platen above roller bearing 62 will slow. When roller bearing 62 encounters and engages notch 58*d* in detent fashion the platen precisely registers in stopped position. Roller bearing 62 can continue up ramp 58*c* to the point of notch 58*d*, instead of stopping before that point, because of the support and vertical movement for ramp 58 being provided by a pneumatic cylinder which inherently can yield slightly under the substantial weight of the moving carousel.

Rubber bumper 59 serves to muffle the noise ordinarily associated with the described braking and stopping action and to absorb the shock which occurs as carousel 14 is brought to a stop. The rubber bumper 59 material is preferably the type of rubber used in aircraft landing gear.

Thus, by use of the described structure for indexing and registration, carousel ring 14*a* is positioned so that each of the platens 18 on corresponding spokes 14*b* is precisely aligned underneath the next selected printing head 20 positioned around the circumference of mounting plate 28.

As roller bearing 62 detentably engages locking ramp 58 a microswitch 64 contacts the undersurface of the particular spoke 14*b* thereabove. Microswitch 64 thus signals operation of piston 30 to cause lowering of all printing heads 20 simultaneously for printing.

Release of piston 60 and associated downward movement of locking ramp 58 is selectively controlled by the operator, with known control means, for example by use of a foot pedal (not shown). Such release frees carousel 14 from its previously rotatably locked position in ramp notch 58*d*. The operator can then manually urge (usually by gripping the closest platen) the entire carousel 14 counter-clockwise to release roller bearing 62 from notch 58*d* and rotate it down take-off end 58*b*, away from ramp 58 so that each platen is moved to a registered position beneath the next print head 20. Once carousel 14 is so released, the operator reactivates cylinder 60 so that locking arm 54 is again gradually moved upwardly to its normal position.

At the same time that locking arm 54 descends microswitch 64 is released from contact with the spoke 14*b* thereabove. This results in release of the pneumatic pressure on piston 30 of head lift mechanism 29 so that spool 32 lowers and presses downwardly on extension bar flanges 44, causing simultaneous lifting of all print heads 20 from printing position, so as not to block manually imposed rotational movement of the carousel mounted platens thereunder.

If preferred or required for a particular printing job, one or more print head positions can be skipped before the operator chooses to again activate the pneumatic cylinder 60 beneath locking arm 54 and thereby engage another spoke-mounted roller bearing 62 to register another platen 18 under the selected print head 20.

Indicated generally as 66 in FIG. 1 is an adjustable frame for supporting a known "silk" screen (actually, now formed of polyester) above a selected platen for printing of goods thereon. The goods are printed by a uniquely structured squeegee/flood bar ink applicator, generally designated 68, which is shown in detail in FIGS. 2–5 (some parts omitted from some views, for clarity). Optionally, a large ring 67 of angle iron may be disposed at the outer ends of spokes 14*b* for providing further structural support to carousel 14 as well as serving as a mounting site for screen frame adjustment bolt assemblies, indicated generally as element number 69 in FIG. 7.

Ink applicator 68 includes a carriage 74 and attached flood bar 76 and squeegee 78. Ink applicator 68 is preferably mounted on its left side by a collar 70 on a radially extending slide 72 mounted longitudinally beneath or within each print head arm 22, in the usual manner above the corresponding screen (not shown) positioned in an adjustable screen frame 66. The right side of ink applicator 68 may be connected and balanced for longitudinal movement thereof beneath the attached arm 22 in a similar collar and slide manner, or may be provided with other known longitudinal movement attachment structure (not shown), for example a channel and roller bearing arrangement, as desired.

As will be clear in view of the structure of ink applicator 68, as shown and to be described, other mounting structures therefor will also suffice, as long as applicator 68 can be signalled by the usual means (for example via electronic push button controls on panel 26), to move radially inward and outward relative to the center of apparatus 10.

As will be described in more detail hereafter, ink applicator 68 has a carriage, generally designated 74, for support and travelling operation of flood bar (or coating blade) 76 and squeegee 78. Generally speaking, during operation, as flood bar 76 moves radially outwardly beneath arm 22 it spreads ink on the gradually lowering printing screen positioned thereunder. Then, after electronically triggered, pneumatically powered, automatic flipping of operating positions, ink applicator 68 travels radially inwardly on slide 72 and squeegee 78, which is then in contact with the completely lowered screen above a corresponding platen, introduces the ink into the screen openings and removes the excess ink.

The preferred structure of squeegee/flood bar ink applicator 68 is shown in great detail in FIGS. 2, 3, 4, and 5. The specific structure of carriage 74 thereof is especially preferred, and is important in order to provide adjustability to ink applicator 68 and to attain the ideal working angles of the coating blade 76 and squeegee 78 relative to the printing work surface, which angles are critical to peak printing performance. However, some variations on the structure to be described, for example with regard to specific forms of connection, may be conceived which will function adequately without changing the nature of the invention.

More specifically, carriage 74 preferably has three rigid bars 80*a*, 80*b*, 80*c* disposed transversely relative to slide 72 and parallel to one another, and, for purposes of the following description, bar 80*a* being forward or outermost relative to the center of apparatus 10, and bar 80*c* being inward or rearwardmost. Bars 80*a*, 80*c* are supported at their opposed ends perpendicularly from side bars 82*a*, 82*b* in such manner as to be pivotal radially outwardly and inwardly thereon, with respect to the center of apparatus 10, as for example, by connectors 84. The center transverse carriage bar, 80*b* is fixed at each of its opposed ends to the sides of the carriage.

Figure 3:
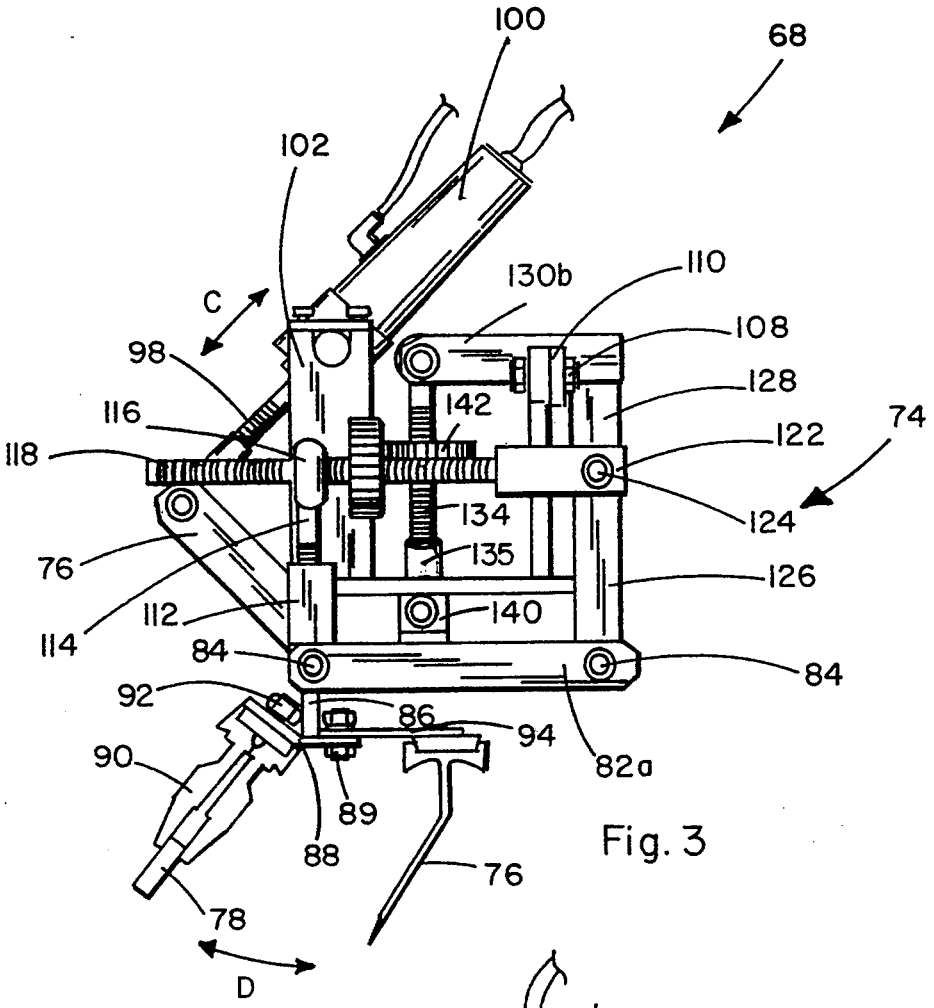
FIG. 3 is a right end view of the mechanism of FIG. 2.

As shown most clearly in FIG. 3, fixed to transverse, forward rigid bar 80*a* and extending downwardly therefrom is a short connecting bar 86 which is fixed at its lower end to a squeegee support plate 88 which is disposed transversely relative to slide 72. Support plate (or mounting strip) 88 is shaped with a formed angle along its entire length and has squeegee 78 attached along the forwardly angled portion by known squeegee clamps 90, for example by nut and bolt assemblies 92.

Parallel to the rearwardly (radially inwardly) angled portion of squeegee support plate 88 there is connected an elongated flat, rigid flood bar support plate 94, which is attached by known connecting structure to transversely disposed flood bar 76. Conceivably, squeegee support plate 88 and flood bar support plate 94 could be formed as one piece, rather than two, individual plates. However, the independent status thereof permits limited adjustment of the the plates, relative to each other, via connecting bolts, such as are indicated at 89 in FIG. 3.

Thus, as is seen in the end view provided in FIG. 3, the described squeegee and flood bar arrangement is far from an inverted "Y", as in the above-discussed known squeegee/flood bar configurations. Rather, the overall schematic impression of the present structure, when viewed from either end, as in FIG. 3, for example, is much closer to being a tilted or "running" "M". Only in this manner can the appropriate blade and squeegee angles be attained for optimal printing quality. Previously, no structure has been developed which uses a combined flood bar/squeegee, flip-flop structure yet permits facile attainment of the optimal print attack angle.

Above parallel carriage bars 80*a*, 80*b*, 80*c* there is connected further structure attaching carriage 74 to slide 72 and for causing overall adjustments of ink applicator 68 and positioning of the flood bar 76 and squeegee 78 so that one or the other is down, in operating position.

Short, paired, parallel piston actuator bars 96 are fixed centrally and extend upwardly from the upper surface of pivotaly mounted transverse carriage bar 80*a*. At their upwardly directed ends piston actuator bars 96 are pivotally connected to the outer end of a piston 98, the inner end of which is slideably housed within a preferably pneumatic cylinder 100. Cylinder 100 is operated by known controls for automatically changing the mode of operation from flooding by coating blade 76 to scraping by squeegee 78, and back, for the next work piece, as will be described.

Figure 2:
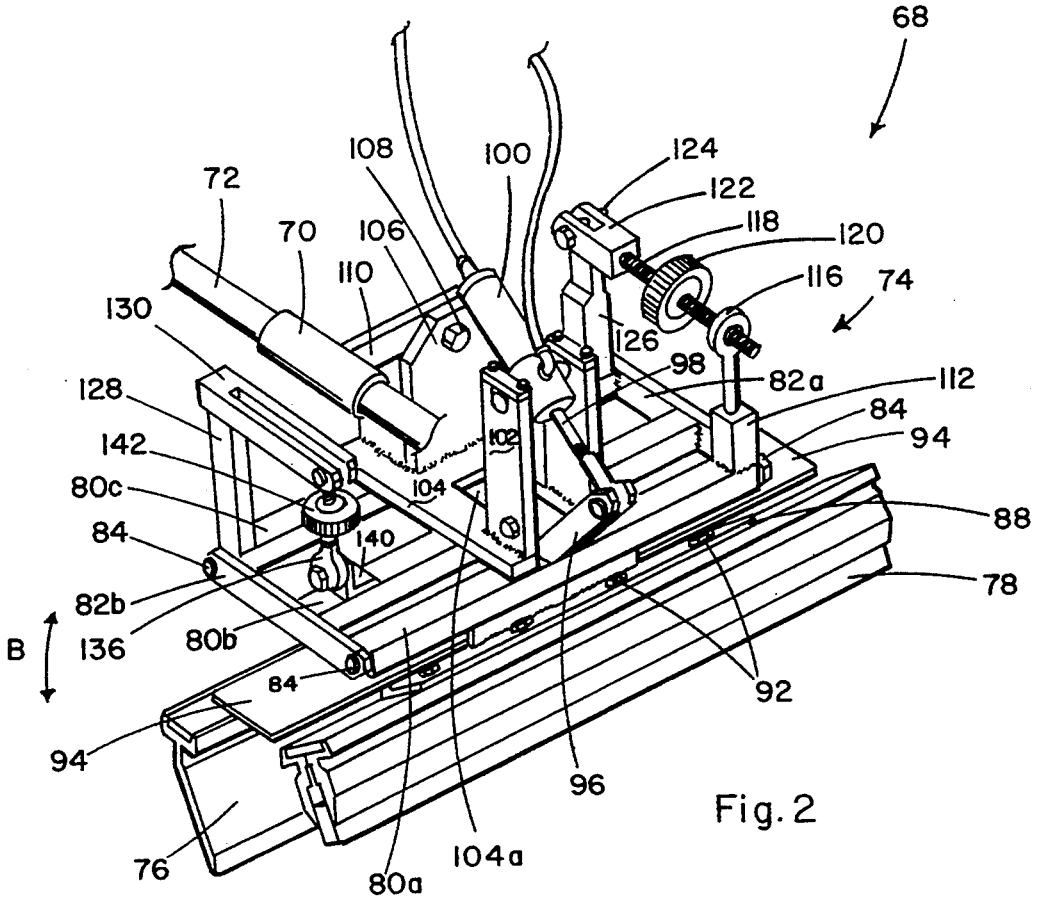
FIG. 2 is an enlarged perspective view of a combined squeegee/flood bar ink applicator of the apparatus of FIG. 1.
Figure 4:
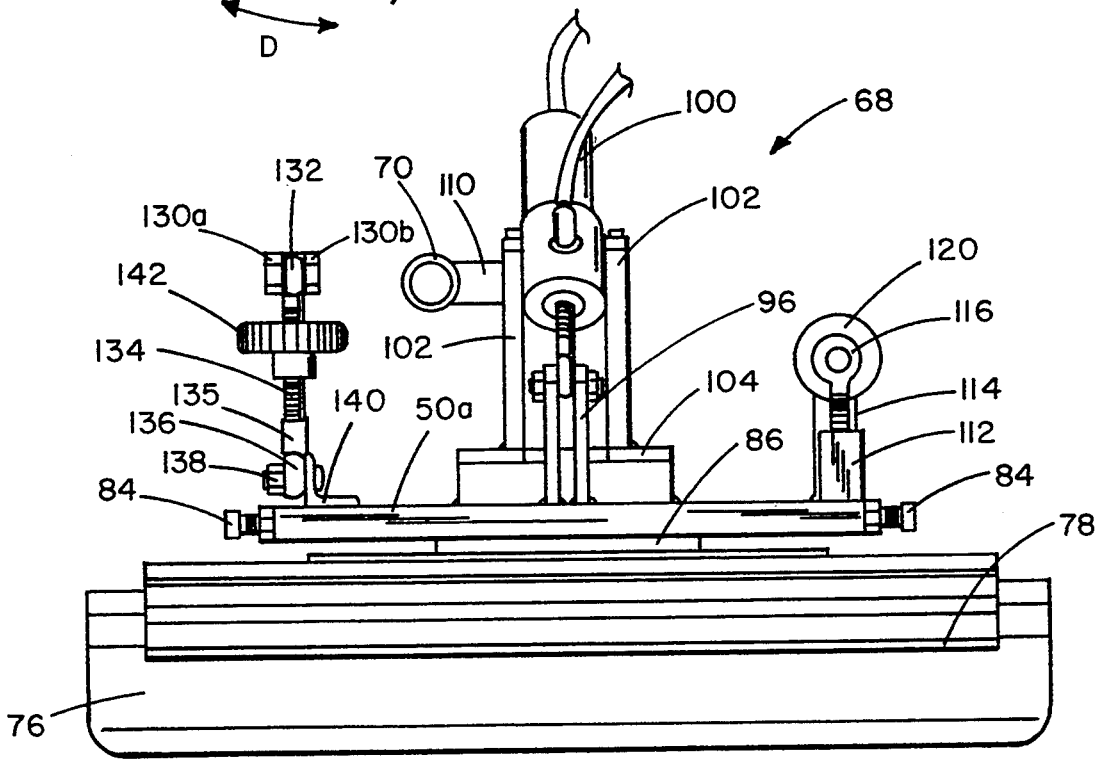
FIG. 4 is is a front elevational view of the mechanism of FIG. 2.
Figure 5:
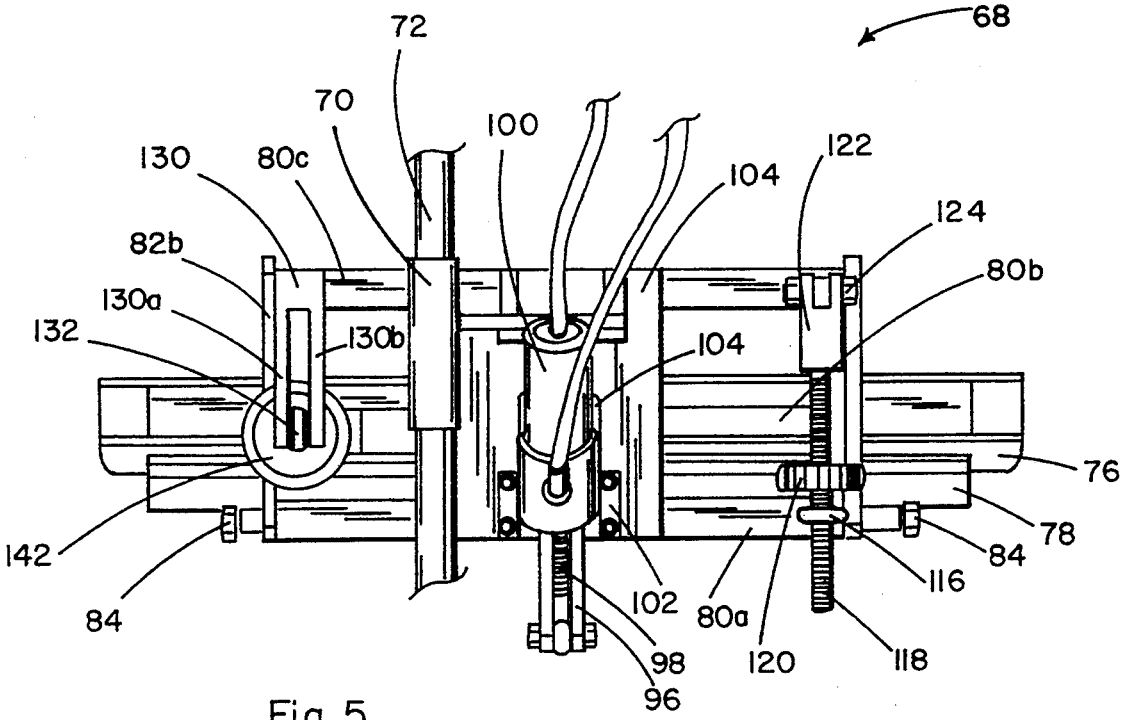
FIG. 5 is a top plan view of the mechanism of FIG. 2.

Cylinder 100 is desireably pivotally secured between the upwardly directed ends of paired, upstanding brackets 102, which extend parallel to each other from their corresponding lower ends which are fixed to carriage plate 104. Carriage plate 104 is fixed to and partially covers the upper surfaces of transverse carriage bars 80*a*, 80*b*, 80*c*, to interconnect such bars, providing structural support to the carriage, as well as providing a mounting site for fixing cylinder brackets 102 thereto. As seen in FIGS. 2 and 4, paired piston actuator bars 96 extend through an opening 104*a* in carriage plate 104 downwardly and an angle toward their mounting site on pivotal transverse carriage bar 80*a*. Thus, by operator selective actuation of electronic controls cylinder 100 can be operated to move piston 98 slideably in and out, as indicated by arrows C in FIG. 3, and thereby push or pull the upper end of actuator bars 96 forward or backward to shift the position of ink applicator 68 from the flooding to the squeegeeing position, or vice versa, as desired.

At the rearwardly (radially inwardly) directed edge of flat carriage plate 104 there is fixed an upwardly extending, heavy flange 106, the top edge of which is penetrated by a heavy machine bolt 108. Bolt 108 attaches flange 106 to one end of a short rigid bar 110. Bar 110 extends outwardly to one side of carriage 74, shown here terminating at the operator's left side, preferably at an opposed end which is fixed perpendicularly to the longitudinal axis of collar 70.

As described previously, collar 70 is penetrated by slide 72. So mounted, carriage 74 is supported slightly to the left of center thereof for smooth travel on slide 72 beneath arm 22. The right side of carriage 74 is similarly supported, or made cooperatively movable by known flood bar and squeegee support means so that such structures are balanced during their respective passes across the work piece.

Adjacent to the right end of forward carriage bar 80*a*, on the upper surface thereof, there is welded a mounting block 112 which threadably receives a correspondingly threaded shaft 114, which shaft extends upwardly therefrom and has a guide eye 116 fixed at its upwardly directed end for passage therethrough of a preferably threaded adjustment shaft 118.

Threaded shaft 118 extends forwardly through guide eye 116 which rotatably supports the shaft outer end. An adjustment knob 120 is centrally mounted on shaft 118, rearwardly of guide ring 116. Threaded shaft 118 extends substantially horizontally rearwardly until threadably engaging dog 122 which is pivotally connected via horizontally disposed pivot shaft 124 to the upper end of an elongated, support block 126. Support block 126 is fixed at the lower end thereof in generally upstanding position upon transverse carriage bar 80*c*, at the extreme right end thereof. With threaded rod 118 so mounted, operation of adjustment knob 120 permits fine adjustment of the pivotal movement of carriage 74 on connectors 84 at the rearward ends of carriage side bars 82*a*, 82*b*. Carriage 74 thus pivots forward or back, as the case may be, as generally indicated by arrows B in FIGS. 2 and 3. This pivotal adjustment feature enhances the operator's ability to precisely control the working angles of and pressure on flood bar 76 and squeegee 78.

At the left end of rearward transverse carriage bar 80*c*, on the upper surface thereof, there is fixed a support column 128 having perpendicularly fixed at the uppermost end thereof a forwardly extending and opening forked member 130. The paired parallel arms 130*a*, 130*b* of forked member 130 pivotally support between the outer ends thereof an eye 132 which is connected to a threaded shaft 134 which extends generally downwardly and threadably connects at its lowermost end to a correspondingly internally threaded hollow shaft 135 which is radially fixed to a another eye 136. Lower eye 136 is pivotally connected, for example, by a bolt 138 to an L-bracket 140, which in turn is fixed adjacent to the left end of fixed transverse carriage bar 80*b*.

An adjustment knob 142 is mounted at its center on threaded shaft 134, so that by rotation thereof the operator can pivotally effect fine adjustment of the position of carriage 74 generally in the directions indicated by arrow B in FIGS. 2 and 3. As discussed with regard to the right side of carriage 74, shown in FIG. 3, FIG. 2 which shows the left side of the carriage also demonstrates that carriage 74 pivots on connectors 84 at the rearward (radially inward) ends of side bars 82*a*, 82*b*, where they connect to the opposed ends of rearward transverse carriage bar 80*c*.

As is clear from the above description and the accompanying figures, numerous modifications on the preferred embodiment may be conceived without departing from the scope of the invention. For example, the simultaneous head lift structure can be adapted for use on a non-carousel type textile printing apparatus, as could the described, combined squeegee/flood bar ink applicator. However, with the above-described construction, it is seen that the unique combination of the new simultaneous head lift mechanism, stop ramp for indexing and platen registration, and flip-flop flood bar/squeegee ink applicator provides a greatly improved automated carousel textile printing apparatus. The new apparatus can be manufactured so economically that it can be produced in the mid-priced range, yet has production capability and operational efficiency which effectively compete with much higher priced, fully automated models.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A textile screen printing apparatus of the carousel type having multiple spaced-apart print heads positioned around the center of the apparatus and extending radially therefrom and at least a corresponding number of platens mounted in a substantially horizontal plane around a carousel of the printing apparatus beneath the print heads, the platens being spaced apart at the same distance from one another as the print heads are spaced apart from one another, the apparatus comprising, a radially centrally disposed member in contact with each of the print heads for causing all print heads to simultaneously lift together and to simultaneously lower together in relation to the horizontal plane, means for controlling the centrally disposed member for causing all print heads to simultaneously lift and lower, means for selectively stopping rotational movement of the carousel, a combined flood bar and squeegee ink applicator mechanism connected to each of the print heads, and means for controlling each of the ink applicator mechanisms, wherein each of the multiple print heads of the apparatus is elongated has an inner end extending radially toward the center of the apparatus, and each of the multiple print heads is indirectly pivotally mounted at a point substantially adjacent to its inner end to the apparatus, and further wherein the means for causing all print heads to simultaneously lift and lower in relation to the respective platens is a heavy spool mounted longitudinally above the center of the apparatus, the spool having an outwardly extending flange which slidably contacts the inner ends of the multiple print heads, and a single fluid cylinder having a piston and the spool being longitudinally connected at a lower end thereof to the single fluid cylinder by the piston, to thereby permit forcibly downward movement of the inner ends of the multiple print heads resulting in pivotal upward movement of radially outward ends of each of the multiple print heads, and to likewise thereby cause gradual pivotal downward movement of the radially outward ends of each of the multiple print heads as the cylinder piston forces the spool upwardly.

2. The textile screen printing apparatus of claim 1, wherein the means for stopping rotational movement of the carousel is adapted for causing simultaneous indexing and registration of a platen beneath each one of the multiple print heads in position for printing on the platen therebeneath, wherein a contact means is mounted on the carousel beneath each one of the platens, and further wherein a single one of the contact means encounters and is engaged by the means for stopping rotational movement as the contact means comes into vertical alignment with the means for stopping rotational movement, the means for stopping rotational movement being selectively releasable by the operator to permit the operator to advance the carousel for indexing at another printing position by causing another contact means to encounter and be engaged by the means for stopping rotational movement of the carousel.

3. The textile screen printing apparatus of claim 2, wherein the means for stopping rotational movement of the carousel is a ramp vertically movably fixed to the apparatus at a position where, in its normally upward position it will necessarily be encountered by a contact means mounted on the carousel beneath a platen as the carousel rotates over the means for stopping rotational movement, and further wherein the ramp is provided with an upwardly sloping approach end, take-off end, and a notch in an upper edge of the ramp, the notch being sized for engagement of a contact means, to thereby provide a structure by which the contact means encounters and moves up the ramp until encountering the notch into which the contact means drops, under the inherent weight of the carousel mounted thereto, and is locked therein, registering the platens in printing position until released by the operator, by effecting downward movement of the ramp to permit the contact means to rotate freely therefrom.

4. The textile screen printing apparatus of claim 2, and further comprising trigger means connected to the means for stopping rotational movement of the carousel and positioned so that when the contact means is engaged by the means for stopping rotational movement of the carousel the multiple print heads will be automatically triggered to move to printing position.

5. The textile screen printing apparatus of claim 1, wherein the combined flood bar and squeegee ink applicator mechanism connected to each of the print heads comprises a carriage longitudinally movably mounted beneath the respective print head, for radial movement inwardly and outwardly relative to a center of the apparatus, a flood bar pivotally mounted on the carriage, transversely to the line of movement thereof, and a squeegee pivotally mounted on the carriage parallel to the flood bar, a longitudinally angled mounting strip to which the squeegee and the flood bar are structurally connected so that the may be simultaneously shifted, flipping their respective positions with respect to which is in operational relationship with a work piece on the corresponding platen for printing, means for structurally connecting the squeegee and the flood bar, and means for causing the squeegee and the flood bar to shift, flipping their respective positions.

6. The textile screen printing apparatus of claim 5, wherein the means for causing the squeegee and flood bar to shift, flipping their respective positions includes a single fluid cylinder connected to the carriage, the single fluid cylinder having a piston, the piston being pivotally connected to the means for structurally connecting the squeegee and the flood bar.

7. The combination of a multi-head type textile printing apparatus and a mechanism which causes simultaneous lifting and lowering of all print heads in the printing apparatus, the printing apparatus having a plurality of print heads extending outwardly from the apparatus, each one of the plurality of print heads having an inner end projecting toward a vertical axis of the apparatus, each one of the plurality of print heads being pivotally mounted on the apparatus, at a point on the print heads outward from the inner end of the corresponding print head, to thereby permit upward and downward pivotal motion of the print head, and the mechanism which causes simultaneous lifting and lowering comprising means for contacting the inner end of each one of the plurality of print heads, the means for contacting being vertically movably mounted on the apparatus above the inner end of each one of the plurality of print heads and in sliding contact with the inner ends, means for vertically movably mounting the means for contacting connected thereto in such manner as to be vertically movable along the vertical axis of the apparatus, and means to cause vertical movement of the means for vertically movably mounting the means for contacting, to thereby cause lifting of each one of the plurality of print heads upon downward vertical movement of the means for effecting vertical movement and lowering of each one of the plurality of print heads upon upward vertical movement of the means for effecting vertical movement.

8. The combination of a carousel-type multi-head textile printing apparatus, a mechanism which causes simultaneous lifting and lowering of all print heads in the printing apparatus, the printing apparatus having a plurality of print heads extending radially outwardly from the apparatus, each one of the plurality of print heads having an inner end projecting toward a central vertical axis of the apparatus, each one of the plurality of print heads being pivotally mounted on the apparatus outwardly from the center of the apparatus, at a point radially outward from the inner end of the corresponding print head, to thereby permit upward and downward pivotal motion of the print head, and the mechanism which causes simultaneous lifting and lowering comprising means for contacting the inner end of each one of the plurality of print heads, the means for contacting being vertically movably mounted centrally on the apparatus above the inner end of each one of the plurality of print heads and in sliding contact therewith, means for vertically movably mounting the means for contacting connected thereto in such manner as to be vertically movable along the central vertical axis of the apparatus, and means to cause vertical movement of the means for vertically movably mounting the means for contacting, to thereby cause lifting of each one of the plurality of print heads upon downward vertical movement of the means for effecting vertical movement and lowering of each one of the plurality of print heads upon upward vertical movement of the means for effecting vertical movement.

9. The combination of a carousel-type multi-head textile printing apparatus and a mechanism which causes simultaneous indexing and registration of all printing platens on the printing apparatus, the printing apparatus having a plurality of print heads fixedly spaced apart from one another around the circumference of the apparatus and extending radially outwardly from the apparatus for simultaneous printing of a plurality of work pieces and a plurality of printing platens, each for supporting one of the plurality of work pieces a plurality of spaced apart rigid spokes extending radially outwardly from the printing apparatus in such manner that all of the rigid spokes are simultaneously rotatable around the apparatus in a horizontal plane beneath the level of the plurality of print heads, each one of the plurality of rigid spokes having one of the plurality of printing platens mounted thereon, the plurality of rigid spokes being spaced at intervals around the apparatus so as to be capable of alignment of substantially each one of the platens beneath a corresponding one of the plurality of print heads, and the mechanism which causes simultaneous indexing and registration of printing platens on the apparatus comprising, contact means rollably mounted to and extending beneath each one of the plurality of rigid spokes of the apparatus, vertically movable stop means fixed on the apparatus and positioned vertically and radially so as to contact a next one of the contact means upon rotational movement of the plurality of rigid spokes, the stop means being adapted for receiving a contact means which comes into contact therewith, to thereby rotationally lock the plurality of rigid spokes to precisely register the plurality of print heads above corresponding printing platens, means to vertically move the stop means for release of a contact means which has been received thereby and to then restore the stops means to its previous position to permit an operator of the apparatus to move the plurality of rigid spokes rotationally around the apparatus so that the contact means on another one of the plurality of rigid spokes can come into contact with the stop means, locking the associated one of the rigid spokes, to thereby index the apparatus to another printing position and register the platen for the other printing position precisely beneath a selected one of the plurality of printing heads for printing of a work piece on the corresponding platen.

10. The combination of claim 9, wherein the vertically movable stop means is a ramp adapted for receiving and locking a contact means which comes into contact therewith by having a notch in the top edge of the ramp upon which the contact means moves, to thereby cause the contact means to drop into the notch and be received and locked therein in detent fashion.

11. The combination of claim 9, wherein the mechanism for effecting simultaneous indexing and registration of all printing platens on the apparatus further comprises means for triggering shifting of the positions of the plurality of print heads when the contact means locks to or releases from the vertically movable stop means.

12. The combination of claim 11, wherein the means for triggering shifting is a microswitch positioned on upwardly on the mechanism for effecting simultaneous indexing and registration, the microswitch contacting the particular one of the plurality of rigid spokes which has the means for contacting connected thereto when the means for contacting contacts the stop means, to thereby signal shifting of the positions of the plurality of print heads such that when the microswitch is contacted the plurality of print heads move to print position and when the microswitch is uncontacted the plurality of print heads move out of print position.

13. The combination of claim 9, wherein the plurality of rigid spokes are mounted on a rigid ring which is manually horizontally rotatable by the operator so as to permit manual shifting of the positions of the platens relative to the print heads.

14. The combination of a textile printing apparatus and a mechanism for coordinated operation of a flood bar and a squeegee on the printing apparatus, the printing apparatus having at least one elongated print head for extending over a work piece to be printed, and at least one platen positionable longitudinally beneath the at least one elongated print head to support a work piece beneath the print head during the printing operation, and the mechanism for coordinated operation of a flood bar and a squeegee comprising a squeegee/flood bar carriage movably mounted to the at least one print head and adapted for longitudinal travel therebeneath of the carriage above the work piece during printing thereof, means for causing the carriage to move longitudinally beneath the at least one print head to which it is mounted, an elongated flood bar and an elongated squeegee mounted to depend from the carriage parallel to one another and transversely in relation to the at least on elongated print head, a mounting strip adapted for receipt of connectors for mounting the flood bar and the squeegee thereon, the mounting strip having a first long edge and a second long edge parallel to the first long edge and an angle formed between the first long edge and the second long edge, so that the strip is bent along the entire length thereof, the flood bar being connected along the first long edge of the mounting strip on one side of the bend, and the squeegee being connected along the second long edge of the mounting strip on the other side of the bend, connectors for mounting the squeegee and the flood bar to the mounting strip, and pivot means connecting the mounting strip beneath the carriage, and a fluid cylinder connected to the pivot means to permit an operator of the apparatus to affect which of the flood bar and the squeegee is operatively disposed in relation to the work piece for performing its corresponding function with regard to printing of the work piece.

15. The combination of claim 14, wherein the angle of the bend formed along the length of the mounting strip opens upwardly toward the squeegee/flood bar carriage, and the elongated flood bar is connected to the mounting strip radially inwardly of the elongated squeegee.

16. The combination of claim 14, wherein the squeegee/flood bar carriage includes a collar rigidly secured thereto and disposed so as to open longitudinally for moveably mounting the squeegee/flood bar carriage to the at least one print head, and further wherein the at least one print head has a radially extending longitudinally disposed slide, the slide being received in the collar to permit radial inward and outward movement of the squeegee/flood bar carriage relative to the center of the textile printing apparatus.

17. The combination of claim 16, wherein the squeegee/flood bar carriage comprises a frame work of rigid bars, the framework including a first rigid bar, a second rigid bar and a third rigid bar all disposed transversely relative to the slide and parallel to one and other, the first rigid bar being disposed radially outermost relative to the center of the apparatus, and the third rigid bar being disposed radially inwardmost relative to the center of the apparatus, a first side bar and a second side bar of equal length disposed longitudinally, parallel to each other, and having the first rigid bar, the second rigid bar and the third rigid bar connected therebetween, the first rigid bar and the third rigid bar being supported at each of their respective two opposed ends perpendicularly from the parallel first side bar and second bar, in such manner that the first rigid bar and the second rigid bar are pivotal radially outwardly and inwardly with respect to the center of the apparatus, the second rigid bar being fixed at each of its opposed ends substantially centrally on the first side bar and the second side bar, the mounting strip for the squeegee and flood bar being connected to and depending from the first transverse rigid bar.

18. The combination of claim 17, wherein the squeegee/flood bar further includes a first support column and a second support column fixed respectively and rising upwardly from the left and right ends of the third rigid transverse carriage bars, the first support column having connected thereto first adjustment means for effecting fine tuning of the angle between the first support column and the first longitudinal side bar of the carriage, and the second support column having connected thereto second adjustment means for permitting fine tuning of the angle of the mounting strip connected to the first transverse rigid bar, relative to the rigid side bars of the carriage.

19. The combination of claim 17, wherein the squeegee/flood bar carriage includes a carriage plate fixed to and partially covering upper surfaces of the first rigid bar, second rigid bar and third rigid bar, interconnecting such bars and providing structural support to the carriage, and further wherein the pivot means includes paired upstanding brackets which are fixed at their lower ends and supported by the carriage plate and which at their upwardly directed ends have secured the fluid cylinder, and paired parallel piston actuator bars are fixed centrally to an upper surface of the pivotally mounted first transverse rigid bar and pivotally connect at their upwardly directed ends to a forwardly directed outer end of a piston of the fluid cylinder.

* * * * *